US009077066B1

(12) United States Patent
Lee

(10) Patent No.: US 9,077,066 B1
(45) Date of Patent: Jul. 7, 2015

(54) WIDEBAND TAPERED ANTENNA WITH PARASITIC GROUNDING ELEMENT

(75) Inventor: Tzung-I Lee, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 203 days.

(21) Appl. No.: 13/419,629

(22) Filed: Mar. 14, 2012

(51) Int. Cl.

| | |
|---|---|
| ***H01Q 9/04*** | (2006.01) |
| ***H01Q 1/38*** | (2006.01) |
| ***H01Q 5/00*** | (2006.01) |
| ***H01Q 5/378*** | (2015.01) |
| *H01Q 19/00* | (2006.01) |

(52) U.S. Cl.
CPC ..... *H01Q 9/0407* (2013.01); *H01Q 19/005* (2013.01); *H01Q 5/378* (2013.01); *H01Q 9/0471* (2013.01)

(58) Field of Classification Search
CPC ..... H01Q 1/38; H01Q 1/243; H01Q 9/0407; H01Q 19/005; H01Q 9/0471
USPC ..... 343/700 MS, 828, 829, 845
See application file for complete search history.

(56) References Cited

U.S. PATENT DOCUMENTS

| | | | | |
|---|---|---|---|---|
| 6,404,395 | B1 * | 6/2002 | Masuda | 343/702 |
| 7,026,999 | B2 * | 4/2006 | Umehara et al. | 343/702 |
| 7,050,010 | B2 * | 5/2006 | Wang et al. | 343/702 |
| 7,180,463 | B2 * | 2/2007 | Chung | 343/824 |
| 7,535,431 | B2 * | 5/2009 | Rowell | 343/846 |
| 7,825,863 | B2 * | 11/2010 | Martiskainen et al. | 343/702 |
| 7,973,726 | B2 * | 7/2011 | Tseng et al. | 343/702 |
| 8,174,457 | B1 * | 5/2012 | Lam | 343/828 |
| 2012/0146853 | A1 * | 6/2012 | Chang et al. | 343/700 MS |
| 2012/0154243 | A1 * | 6/2012 | Kim | 343/860 |

OTHER PUBLICATIONS

The A.R.R.L. Antenna Book, American Radio Relay League, 1988, pp. 2-24 to 2-25.*

* cited by examiner

*Primary Examiner* — Robert Karacsony
*Assistant Examiner* — Daniel J Munoz
(74) *Attorney, Agent, or Firm* — Lowenstein Sandler LLP

(57) ABSTRACT

Methods and systems for extending a bandwidth of a wideband antenna of a user device are described. A wideband antenna includes a parasitic element coupled to ground and a single radio frequency (RF) input coupled to an antenna structure at a first point. The antenna structure comprises a tapered side that tapers away from the first point to create an increasingly larger gap between the antenna structure and ground. The antenna structure is configured to operate as a feeding structure to the parasitic element, the parasitic element not being conductively connected to the antenna structure.

29 Claims, 10 Drawing Sheets

WIDEBAND TAPERED ANTENNA WITH PARASITIC GROUNDING ELEMENT

BACKGROUND OF THE INVENTION

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops, and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high band. One resonant mode in the lower frequency band and one resonant mode in the high band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union. Application services include wide-area wireless voice telephone, mobile Internet access, video calls and mobile TV, all in a mobile environment. The required frequency bands for 3G applications may be GSM850/EGSM in low band and DCS/PCS/WCDMA in high band. The 3G band is between 824 MHz and 960 MHz. Long Term Evolution (LTE) and LTE Advanced (sometimes generally referred to as 4G) are communication standards that have been standardized by the 3rd Generation Partnership Project (3GPP). However, in order to extend the frequency coverage down to 700 MHz for 4G/LTE application, antenna bandwidth needs to be increased especially in the low band. There are two common LTE bands used in the United States from 704 MHz-746 MHz (Band 17) and from 746 MHz-787 MHz (Band 13). Conventional solutions increase the antenna size or use active tuning elements to extend the bandwidth. Alternatively, conventional solutions use separate antennas to achieve different frequency bands and use a switch to switch between the antennas. These solutions are not conducive to use in user devices, often because of the size of the available space for antennas within the device.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION OF THE PRESENT INVENTION

Figure 1:
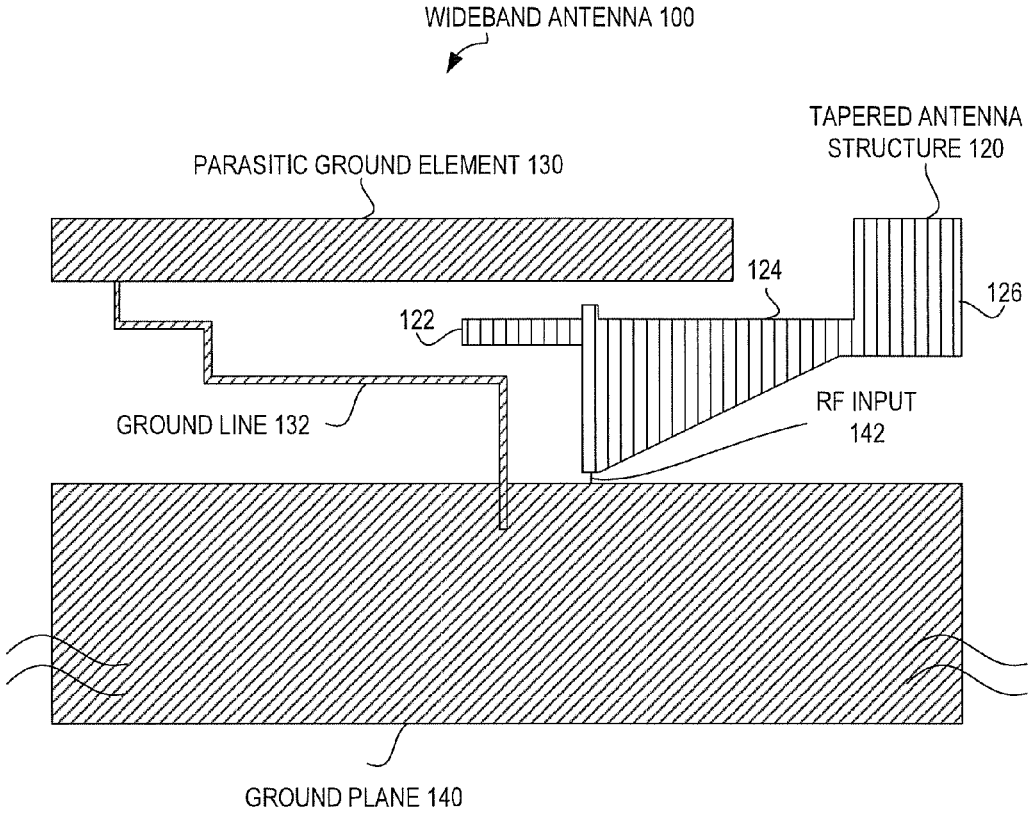
FIG. 1 illustrates one embodiment of a wideband antenna including a tapered antenna structure and a parasitic ground element.

Methods and systems for extending a bandwidth of a wideband antenna of a user device are described. A wideband antenna includes a parasitic element coupled to ground and a single radio frequency (RF) input coupled to an antenna structure at a first point. The antenna structure comprises a tapered side that tapers away from the first point to create an increasingly larger gap between the antenna structure and ground. The antenna structure is configured to operate as a feeding structure to the parasitic element, the parasitic element not being conductively connected to the antenna structure. The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

As described above, the conventional antenna usually has only one resonant mode in the lower frequency band and one resonant mode in the high band. The embodiments described herein extend the bandwidth of the wideband antenna by using a tapered antenna structure and a parasitic ground element. The antenna structure may include other elements to add additional resonant modes to extend the frequency coverage. In one embodiment, the wideband antenna extends the frequency coverage down to 700 MHz for use in 4G/LTE applications, as well as provides additional resonances in the high band. In one embodiment, a wideband antenna has a tapered antenna structure coupled to a single RF input, and the tapered antenna structure operates as a feeding structure to a parasitic element disposed near the tapered antenna structure. The wideband antenna has a single RF input that drives the tapered antenna structure as an active or driven element and the passive antenna is a parasitic element that is fed by the tapered antenna structure. By coupling the tapered antenna structure and the parasitic ground element, two resonant modes can be created in the lower band and two or more resonant modes can be created in the higher band. The proposed wideband antenna uses two resonant modes to cover 700 MHz-960 MHz to cover the both the 3G band and the LTE band in a single RF input. The embodiments described herein are not limited to use in 3G and LTE bands, but could be used to increase the bandwidth of a multi-band frequency in other bands, such as Dual-band Wi-Fi, GPS and Bluetooth frequency bands. The embodiments described herein provide a wideband antenna to be coupled to a single RF input feed and does not use any active tuning to achieve the extended bandwidths. The embodiments described herein also provide a wideband antenna with increased bandwidth in a size that is conducive to being used in a user device.

FIG. 1 illustrates one embodiment of a wideband antenna 100 including a tapered antenna structure 120 and a parasitic ground element 130. In this embodiment, the wideband antenna 100 is fed at the single RF input 142 at the tapered antenna structure 120 and the parasitic ground element 130 is a parasitic element. A parasitic element is an element of the wideband antenna 100 that is not driven directly by the single RF input 142. Rather, the single RF input 142 directly drives another element of the wideband antenna (e.g., the tapered antenna structure 120), which parasitically induces a current on the parasitic element. In particular, by directly inducing current on the tapered antenna structure 120 by the single RF input 142, the directly-fed structure radiates electromagnetic energy, which causes another current on the parasitic ground element 130 to also radiate electromagnetic energy, creating multiple resonant modes. In the depicted embodiment, the parasitic ground element 130 is parasitic because it is physically separated from the tapered antenna structure 120 that is driven at the single RF input 142. It can also be said that the parasitic element 130 is not conductively connected to the tapered antenna structure 120. The driven tapered antenna structure 120 parasitically excites the current flow of the parasitic ground element 130. In one embodiment, the parasitic ground element 130 and tapered antenna structure 120 can be physically separated by a gap. Alternatively, other antenna configurations may be used to include a driven element and a parasitic element. The dimensions of the tapered antenna structure 120 and the parasitic ground element 130 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another.

In FIG. 1, the ground is a radiation ground plane 140. The ground plane 140 may be a metal frame of the user device. The ground plane 140 may be a system ground or one of multiple grounds of the user device. The RF input 142 may be a feed line connector that couples the wideband antenna 100 to a feed line (also referred to as the transmission line), which is a physical connection that carriers the RF signal to and/or from the wideband antenna 100. The feed line connector may be any one of the three common types of feed lines, including coaxial feed lines, twin-lead lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to tapered antenna structure 120 of the wideband antenna 100, but is not conductively connected to the parasitic ground element 130 of the wideband antenna 100. However, the tapered antenna structure 120 is configured to operate as a feeding structure to the parasitic ground element 130.

In one embodiment, the wideband antenna 100 is disposed on an antenna carrier, such as a dielectric carrier of the user device. The antenna carrier may be any non-conductive material, such as dielectric material, upon which the conductive material of the wideband antenna 100 can be disposed without making electrical contact with other metal of the user device. In another embodiment, portions of the wideband antenna 100 may be disposed on or within a circuit board, such as a printed circuit board (PCB). Alternatively, the wideband antenna 100 may be disposed on other components of the user device or within the user device as would be appreciated by one of ordinary skill in the art having the benefit of this disclosure. It should be noted that the wideband antenna 100 illustrated in FIG. 1 is a planar, two-dimensional (2D) structure. However, as described herein, the wideband antenna 100 may include 3D structures, as well as other variations than those depicted in FIG. 1. In one embodiment, the parasitic ground element 130, the tapered antenna structure 120, or both can be partially disposed on two or more sides of the antenna carrier. For example, the parasitic ground element 130 can be disposed on the front surface and the top surface of the antenna carrier. Alternatively, the tapered antenna structure 120 can be disposed on the front surface and the top surface of the antenna carrier. Similarly, portions of these elements can be disposed on sides of the antenna carrier as would be appreciated by one of ordinary skill in the art having the benefit of this disclosure.

Using the tapered antenna structure 120 and the parasitic ground element 130, the wideband antenna 100 can create multiple resonant modes using the single RF input 142, such as three or more resonant modes. In one embodiment, the tapered antenna structure 120 and the parasitic ground element 130 are configured to extend a bandwidth of the wideband antenna 100. In one embodiment, the wideband antenna 100 has multiple resonant modes with a bandwidth between 700 MHz and 2.7 GHz. In another embodiment, the wideband antenna 100 has multiple resonant modes with a bandwidth between 700 MHz and 6 GHz. In one embodiment, the parasitic ground element 130 is configured to provide a first resonant mode, centered at 700 MHz, for example, and the other resonant mode the tapered antenna structure 120 is configured to provide three resonant modes, such as a second resonant mode centered at 1 GHz, a third resonant mode centered at 1.7 GHz, and a fourth resonant mode centered at 2.4 GHz. In another embodiment, the wideband antenna 100 can be configured to create a resonant mode for LTE 700 plus resonant modes for penta-band. In telecommunications, the terms multi-band, dual-band, tri-band, quad-band, and penta-band refer to a device, such as the user device described herein, supporting multiple RF bands used for communication. In other embodiments, the antennas can be designed to cover an eight-band LTE/GSM/UMTS, the GSM850/900/1800/1900/UMTS penta-band operation, or the LTE700/GSM850/900 (698-960 MHz) and GSM 1800/190/UMTS/LTE2300/2500 (1710-2690 MHz operation. In the user device context, the purpose of doing so is to support roaming between different regions whose infrastructure cannot support mobile services in the same frequency range. These frequency bands may be Universal Mobile Telecommunication Systems (UMTS) frequency bands, GSM frequency bands, or other frequency bands used in different communication technologies, such as, for example, cellular digital packet data (CDPD), general packet radio service (GPRS), enhanced data rates for GSM evolution (EDGE), 1 times radio transmission technology (1xRTT), evaluation data optimized (EVDO), high-speed downlink packet access (HSDPA), WiFi, WiMax, etc.

In the depicted embodiment, the tapered antenna structure 120 includes a triangular portion 124 with one of the corners disposed near the ground plane 140. The triangular portion 124 includes a tapered side that extends from the one corner to another corner that is disposed farther away from the ground plane 140 than the one corner. In one embodiment, at least one of the sides of the tapered antenna structure is tapered. The tapered side creates a first gap between the tapered antenna structure 120 and the ground plane 140 at a first point where the single RF input is coupled to the tapered antenna structure 120. The tapered side creates a second gap between the tapered antenna structure 120 and the ground plane 140 at a second point that is farther away from the single RF input 142 than the first point, the second gap being greater than the first gap. In another embodiment, the tapered side tapers away from the ground plane at a specified angle from the ground plane 140 at a feed location. In another embodiment, another side of the tapered antenna structure 120 that extends away from the ground plane on the other side is not tapered. In another embodiment, both sides are tapered away from the ground plane. It should also be noted that the tapered antenna structure does not have to be triangular in shape, and may have one or more sides that taper away from the ground plane 140 at the feed location as would be appreciated by one of ordinary skill in the art having the benefit of this disclosure.

In another embodiment, the tapered antenna structure 120 also includes an arm portion 122 that extends out from a side opposite to the tapered side. The tapered antenna structure 120 also includes an extension portion 126 that extends out from the tapered side of the triangular portion 124. Alternatively, the tapered antenna structure 120 may have other elements to change the frequency response of the wideband antenna 100.

In one embodiment, the arm portion 122, the triangular portion 124, and the extension portion 126 provides three resonant modes. For example, the triangular portion 124 may provide a second resonant mode in a high band. The triangular portion 124 provides a given bandwidth. The arm portion 122 is configured to provide a third resonant mode in the high band and is configured to increase the bandwidth of the wideband antenna 100 in the high band. Similarly, the extension portion 126 is configured to provide a fourth resonant mode in the high band and is configured to increase the bandwidth of the wideband antenna 100 in the high band. Similarly, the parasitic ground element 130 is configured to provide a first resonant mode in a low band and is configured to increase the bandwidth of the wideband antenna 100 in the low band. Modifications to the dimensions of the portions of the tapered antenna structure 120 (e.g., 122, 124, and/or 126) may change the frequency and impedance matching of the wideband antenna 100 as would be appreciated by one of ordinary skill in the art having the benefit of this disclosure.

In the depicted embodiment, the parasitic ground element 130 has a rectangular shape and is disposed a distance from the ground plane 140. In this embodiment, the parasitic ground element 130 is disposed in parallel to the ground plane 140. The parasitic ground element 130 is grounded via a ground line 132. The ground line 132 and its size and position can also affect the frequency and impedance matching. In one embodiment, the parasitic ground element 130 is configured to operate as a portion of a capacitor, and the ground line 132 is configured to operate as an inductor. The tapered antenna structure 120 is configured to operate as a feeding structure to the parasitic ground element 130, and the parasitic ground element 130 and the ground line 132 (usually a meandered line) form a series LC resonances to provide an additional resonant mode. In this embodiment, the resonant mode is in the low band and can extend the bandwidth into the LTE frequency band, for example.

It should be noted that the tapered side of the triangular portion 124 contributes to the bandwidth of the wideband antenna 110. The meandering ground line 132 contributes to impedance matching for the low band, and increases the bandwidth in the low band. For example, the triangular portion 124 increases the bandwidth between 900 and 2700 MHz, and the meandering ground line 132 and parasitic ground element 130 extend the bandwidth between 700 and 900 MHz. The arm portion 122 can increase the bandwidth in the high band and can be used to create a resonant mode in the high band. The arm portion 122 can also contribute to the coupling between the tapered antenna structure 120 and the parasitic ground element 130. The arm portion 122 can also contribute to the impedance matching, but the tapered antenna structure 120 does not need the arm portion 122 for proper operation. Similarly, the extension portion 126 can increase the bandwidth in the high band and can be used to create another resonant mode in the high band. The extension portion 126 can also contribute to impedance matching, but is not needed for proper operation of the tapered structure antenna 120. Because of the location of the extension portion 126 with respect to the parasitic ground element 130 and the ground plane 140, the extension portion 126 has a different effect on the frequency than does the arm portion 122 as would be appreciated by one of ordinary skill in the art having the benefit of this disclosure.

Figure 2:
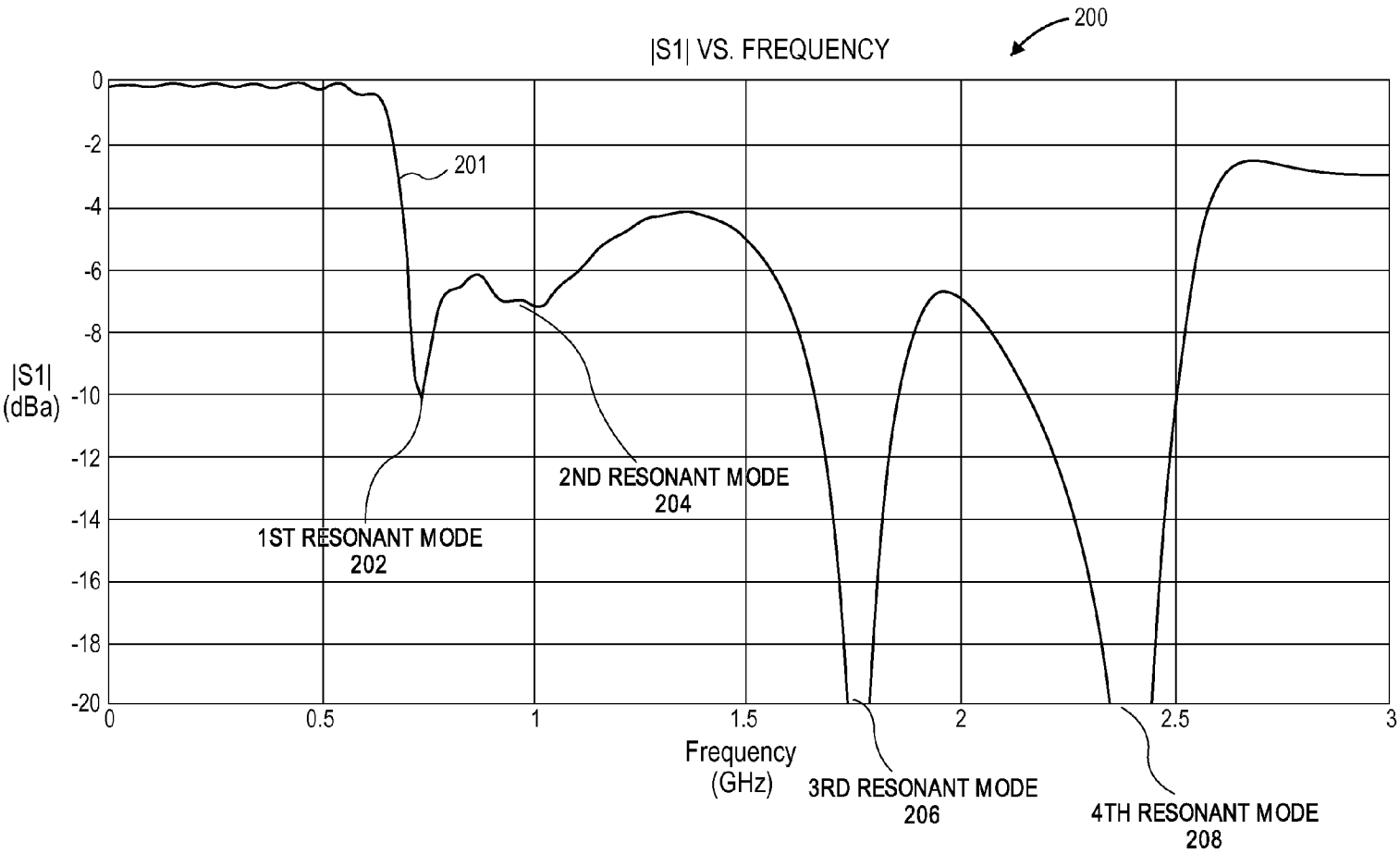
FIG. 2 is a graph of measured return loss of the wideband antenna of FIG. 1 according to one embodiment.

In the depicted embodiment, there are four resonate modes created by the tapered antenna structure 120 and the parasitic ground element 130. In one embodiment, the parasitic ground element 130 provides the first resonant mode, and the tapered antenna structure 120 provides the other three resonant modes. In one embodiment, the first resonant mode is in a range between 680 MHz and 900 MHz, the second resonant mode is in a range between 900 MHz and 1.4 GHz, the third resonant mode is in a range between 1.4 GHz and 2.0 GHz, and the fourth resonant mode is in a range between 2.0 GHz and 2.7 GHz, such as illustrated in FIG. 2. In another embodiment, the first resonant mode is in a range between 300 MHz and 600 MHz, the second resonant mode is in a range between 600 MHz and 1 GHz, the third resonant mode is in a range between 1 GHz and 2 GHz, and the fourth resonant mode is in a range between 2 GHz and 3 GHz. Alternatively, other resonant modes may be achieved that are higher than 3 GHz. Alternatively, other combination of resonant modes may be achieved as would be appreciated by one of ordinary skill in the art having the benefit of this disclosure. In other embodiments, more or less than four resonant modes may be achieved as would be appreciated by one of ordinary skill in the art having the benefit of this disclosure. It should also be noted that the first, second, third and fourth notations on the resonant modes are not be strictly interpreted to being assigned to a particular frequency, frequency range, or elements of the wideband antenna. Rather, the first, second, third, and fourth notations are used for ease of description. However, in some instances, the first, second, third and fourth are used to designate the order from lowest to highest frequencies. Alternatively, other orders may be achieved as would be appreciated by one of ordinary skill in the art having the benefit of this disclosure. In one embodiment, the wideband antenna 100 with the coupled parasitic ground element can be configured for the LTE (700/2700), UMTS, GSM (850, 800, 1800, and 1900), GPS, and WI-FI/Bluetooth frequency bands. In effect, the wideband antenna 100 has a bandwidth between 700 MHz to 2700 MHz. Conventional multiband antennas for mobile devices usually have a narrow bandwidth and can only cover 824 MHz to 960 MHz and 1710 MHz to 2170 MHz. Using the embodiments described herein with the tapered antenna structure and parasitic ground coupling, low impedance variation is feasible over 700 MHz to 2700 MHz frequency range. Hence, the embodiments described herein can be utilized in any application in the frequency range, like LTE (700/2700), UMTS, GSM (850, 900, 1800, and 1900), GPS, and WI-FI/Bluetooth. In another embodiment, the wideband antenna 100 can be designed to operate in the following target bands: 1) Verizon LTE band: 746 to 787 MHz; 2) US 850 (band 5): 824 to 894 MHz; 3) GSM900 (band 8): 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. These resonance bandwidths may be characterized by VNA measurements with about −5 dB bandwidth (BW). Alternatively, the wideband antenna 100 can be designed to operate in different combinations of frequency bands as would be appreciated by one of ordinary skill in the art having the benefit of this disclosure. Alternatively, the wideband antenna 100 can be configured to be tuned to other frequency bands as would be appreciated by one of ordinary skill in the art having the benefit of this disclosure.

In another embodiment, the tapered antenna structure 120 and the parasitic ground element 130 can be configured to create three resonant modes or more than four resonant modes. In one embodiment, five resonant modes are archived. The first resonant mode is in a range between 680 MHz and 900 MHz, the second resonant mode is in a range between 900 MHz and 1.4 GHz, the third resonant mode is in a range between 1.4 GHz and 2.0 GHz, and the fourth resonant mode is in a range between 2.0 GHz and 2.7 GHz, and the fifth resonant mode is in a range between 2.7 GHz and 4.0 GHz. Alternatively, additional resonant modes above 4 GHz can be achieved, such as a sixth resonant mode in a range between 4 GHz and 6 GHz. In one embodiment, two resonant modes can be synthesized and combined together as would be appreciated by one of ordinary skill in the art having the benefit of this disclosure. In another embodiment, it could be said that the first resonant mode has an approximate 280 MHz bandwidth centered at approximately 960 MHz, the second resonant mode has an approximate 65 MHz bandwidth centered at approximately 780 GHz, the third resonant mode has an approximate 200 MHz bandwidth centered at approximately 1.8 GHz, the fourth resonant mode has an approximate 160 MHz bandwidth centered at approximately 1.97 GHz, and the fifth resonant mode has an approximate 260 MHz bandwidth centered at approximately 2.7 GHz.

FIG. 2 is a graph 200 of measured return loss 201 of the wideband antenna 100 of FIG. 1 according to one embodiment. The graph 200 shows the measured return loss (|S1|) of the structure of the wideband antenna 100 of FIG. 1. The wideband antenna 100 covers approximate 680 MHz to 2760 MHz. The wideband antenna 100 provides a first resonant mode 202 centered at approximately 700 MHz, a second resonant mode 204 centered at approximately 1 GHz, a third resonant mode 206 centered at approximately 1.7 GHz, and a fourth resonant modes 208 centered at approximately 2.4 GHz. As described herein, other resonant modes may be achieved.

As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. For example, the target band can be Verizon LTE band and the GSM850/900 band, and the wideband antenna 100 can be tuned to optimize the efficiency for this band as well as for other bands, such as DCS, PCS, and WCDMA bands. The efficiency of the wideband antenna may be done by adjusting dimensions of the 2D structure, the gaps between the elements of the structure, or a combination of both. Similarly, 3D structures can be modified in dimensions and gaps between elements to improve the efficiency in certain frequency bands as would be appreciated by one of ordinary skill in the art having the benefit of this disclosure. It should also be noted that the antennas described herein may be implemented with two-dimensional geometries, as well as three-dimensional geometries as described herein.

Figure 3:
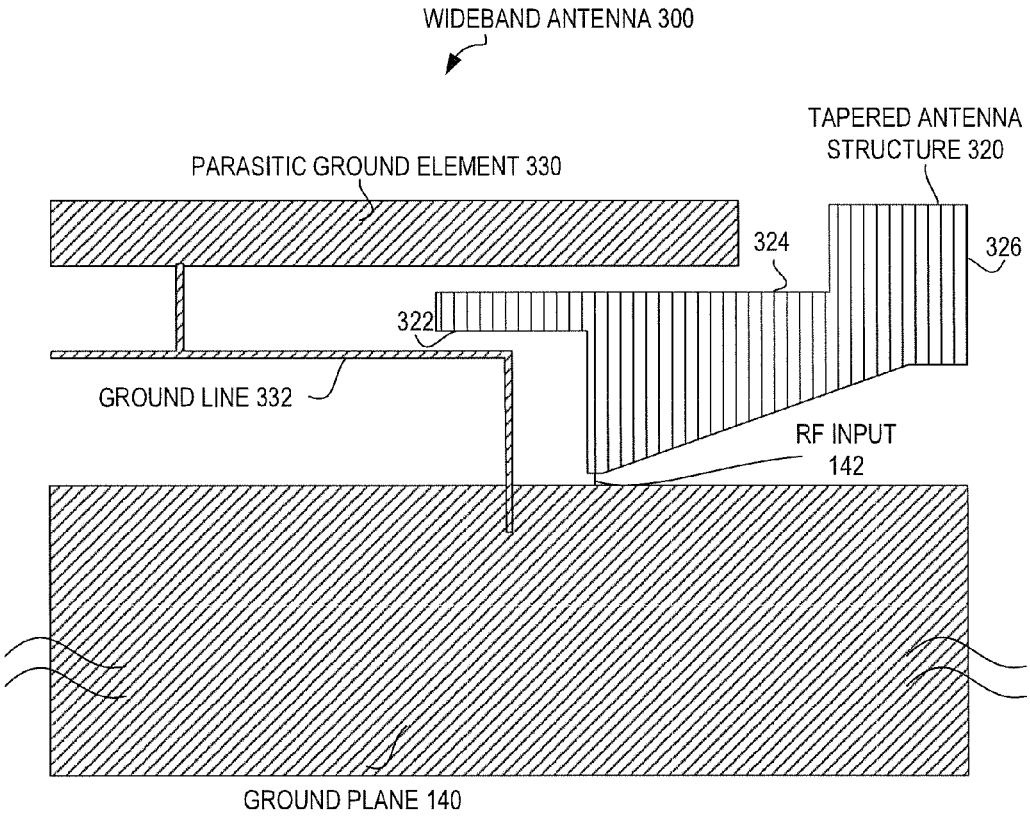
FIG. 3 illustrates another embodiment of a wideband antenna including a tapered antenna structure and a parasitic ground element.

FIG. 3 illustrates another embodiment of a wideband antenna 300 including a tapered antenna structure 320 and a parasitic ground element 330. In this embodiment, the wideband antenna 300 is fed at the single RF input 142 at the tapered antenna structure 320 and the parasitic ground element 330 is a parasitic element. The single RF input 142 directly drives the tapered antenna structure 320, which parasitically induces a current on the parasitic element 330. In particular, by directly inducing current on the other element by the single RF input 142, the directly-fed element radiates electromagnetic energy, which causes another current on the parasitic element to also radiate electromagnetic energy, in multiple resonant modes.

As described above, the wideband antenna 300 may be disposed on an antenna carrier, such as a dielectric carrier of the user device, on or within a circuit board, such as a printed circuit board (PCB), or on other components of the user device or within the user device as would be appreciated by one of ordinary skill in the art having the benefit of this disclosure. It should be noted that the wideband antenna 300 illustrated in FIG. 3 is a planar, 2D structure, but may also be a 3D structure such as described above Like the wideband antenna 100 described above, the wideband antenna 300 may create multiple resonant modes and may have a bandwidth between 700 MHz and 2.7 GHz.

In one embodiment, at least one of the sides of the tapered antenna structure 320 is tapered. The tapered side creates a first gap between the tapered antenna structure 320 and the ground plane 340 at a first point where the single RF input 142 is coupled to the tapered antenna structure 320. The tapered side creates a second gap between the tapered antenna structure 320 and the ground plane 140 at a second point that is farther away from the single RF input 142 than the first point, the second gap being greater than the first gap. In another embodiment, the tapered side tapers away from the ground plane at a specified angle from the ground plane 140 at a feed location. In another embodiment, another side of the tapered antenna structure 120 that extends away from the ground plane on the other side is not tapered. In another embodiment, both sides are tapered away from the ground plane. It should also be noted that the tapered antenna structure does not have to be triangular in shape, and may have one or more sides that taper away from the ground plane 140 at the feed location as would be appreciated by one of ordinary skill in the art having the benefit of this disclosure.

In another embodiment, the tapered antenna structure 320 also includes an arm portion 322 that extends out from a side opposite to the tapered side. The tapered antenna structure also includes an extension portion 326 that extends out from the tapered side of the triangular portion 324. Alternatively, the tapered antenna structure 320 may have other elements to change the frequency response of the wideband antenna 300.

In one embodiment, the arm portion 322, the triangular portion 324, and the extension portion 326 provides three resonant modes. For example, the triangular portion 324 may provide a second resonant mode in a high band. The triangular portion 324 provides a given bandwidth. The arm portion 322 is configured to provide a third resonant mode in the high band and is configured to increase the bandwidth of the wideband antenna 300 in the high band. Similarly, the extension portion 326 is configured to provide a fourth resonant mode in the high band and is configured to increase the bandwidth of the wideband antenna 300 in the high band. Similarly, the parasitic ground element 330 is configured to provide a first resonant mode in a low band and is configured to increase the bandwidth of the wideband antenna 300 in the low band. Modifications to the dimensions of the portions of the tapered antenna structure 320 (e.g., 322, 324, and/or 326) may change the frequency and impedance matching of the wideband antenna 300 as would be appreciated by one of ordinary skill in the art having the benefit of this disclosure.

Figure 7:
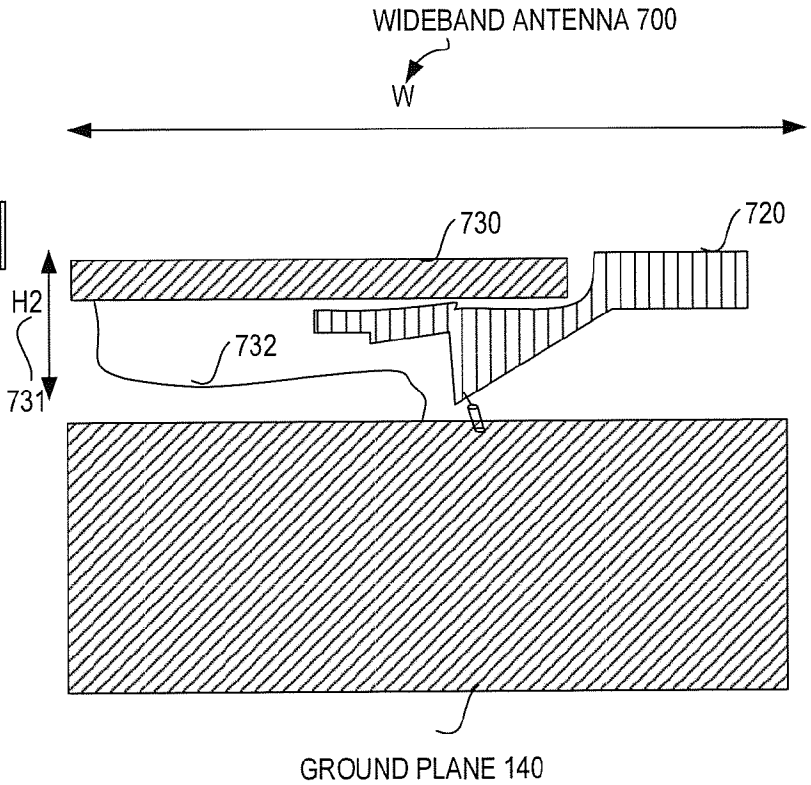
FIG. 7 illustrates another embodiment of a wideband antenna including a tapered antenna structure and a parasitic ground element, the wideband antenna having a second height.
Figure 6:
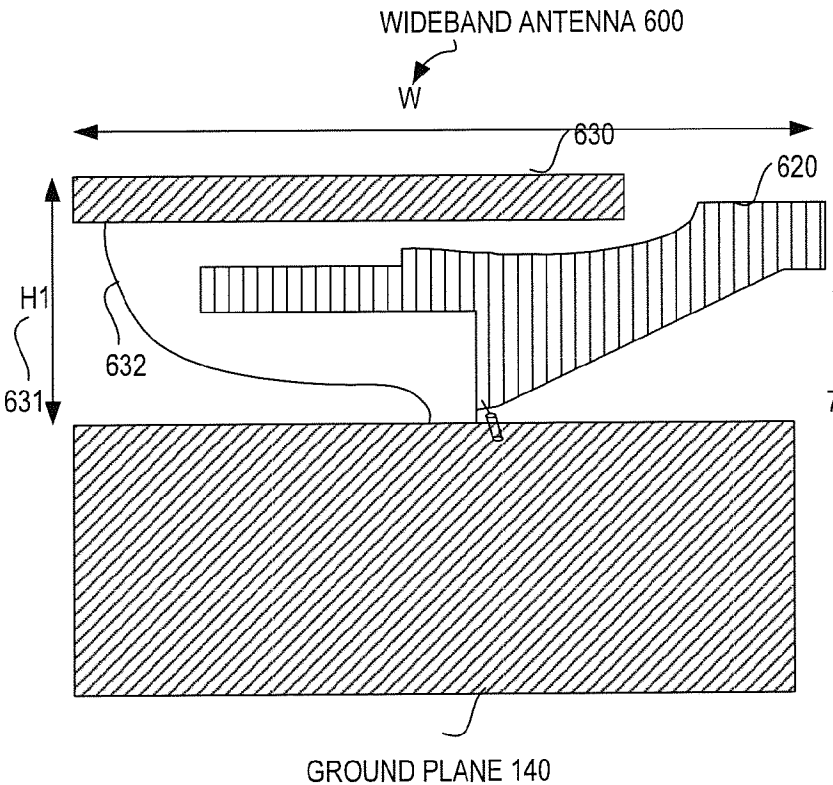
FIG. 6 illustrates another embodiment of a wideband antenna including a tapered antenna structure and a parasitic ground element, the wideband antenna having a first height.
Figure 8:
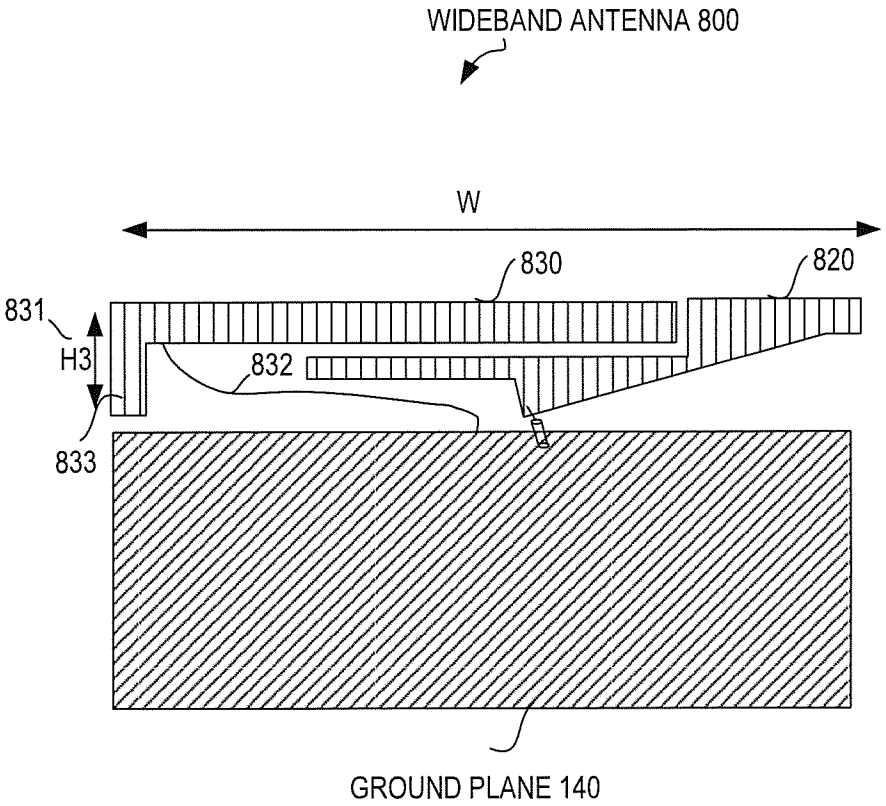
FIG. 8 illustrates another embodiment of a wideband antenna including a tapered antenna structure and a parasitic ground element, the wideband antenna having a third height.

In the depicted embodiment, the parasitic ground element 330 has a rectangular shape and is disposed a distance from the ground plane 140. In this embodiment, the parasitic ground element 330 is disposed in parallel to the ground plane 140. The parasitic ground element 330 is grounded via a ground line 332. The size of the ground line 332 and its dimensions can affect the resonant modes and the impedance matching. Changes to the dimensions and positioning of the ground line 332, for example, may affect the first and fourth resonant modes as described above. The ground line 332 may also affect the third resonant mode. Like the ground line 132 described above, the ground line 332 may contribute to the impedance matching for the low band, and increase the bandwidth in the low band. Similarly, the location and dimensions of the arm portion 322, the extension portion 336, the triangular portion 334, the parasitic ground element 330, and the ground line 332 may change the resonant modes and the bandwidth of the wideband antenna 300. It should also be noted that FIG. 3 illustrates different dimensions and shapes for the tapered antenna structure 320 than those illustrated and described with respect to the tapered antenna structure 120. FIGS. 6-8 illustrates other dimensions and shapes that can be used for the wideband antenna.

Figure 4:
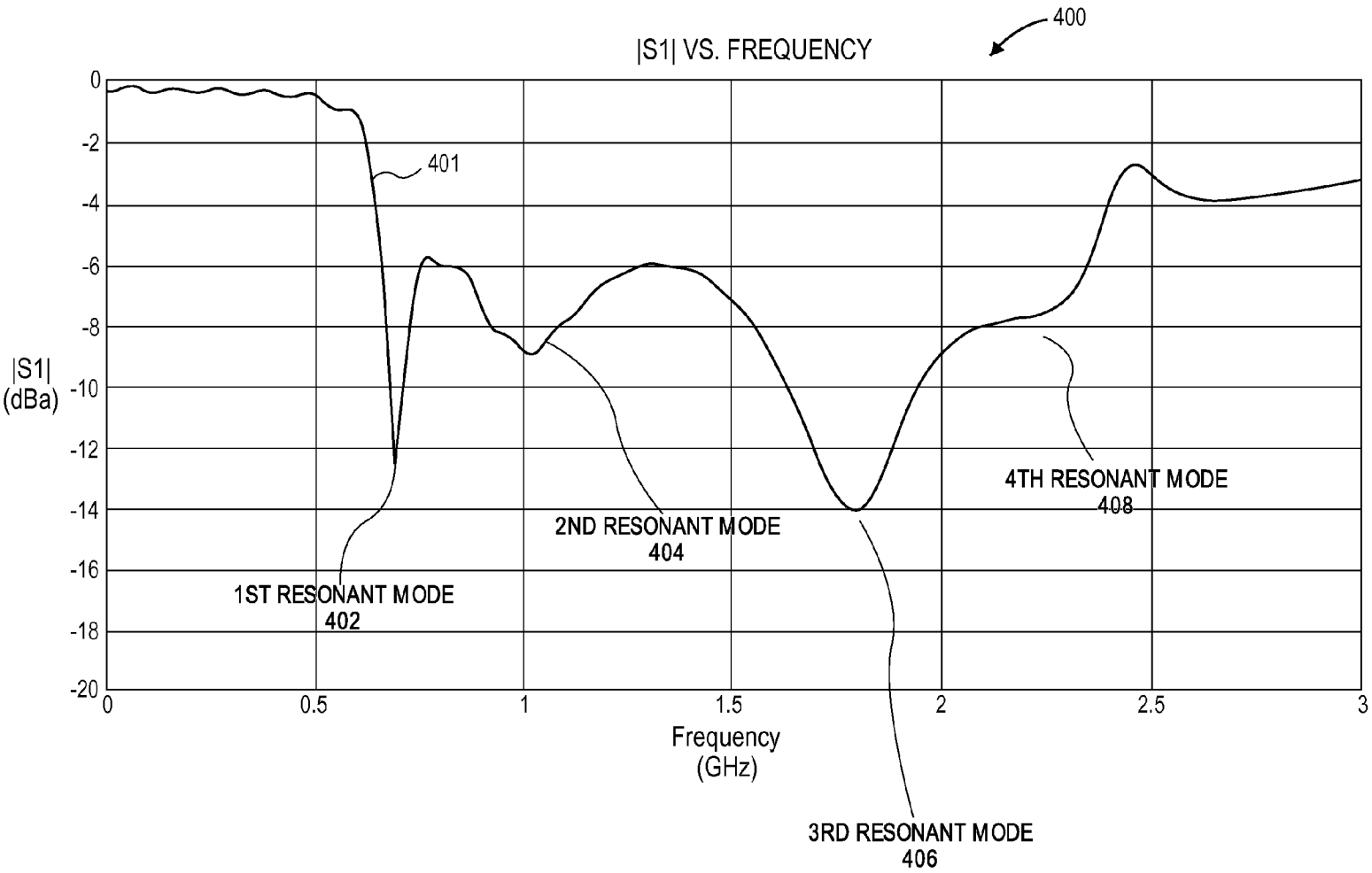
FIG. 4 is a graph of measured return loss of the wideband antenna of FIG. 3 according to one embodiment.

FIG. 4 is a graph 400 of measured return loss 401 of the wideband antenna 300 of FIG. 3 according to one embodiment. The graph 400 shows the measured return loss (|S1|) of the structure of the wideband antenna 300 of FIG. 3. The wideband antenna 300 covers approximate 680 MHz to 2760 MHz. The wideband antenna 300 provides a first resonant mode 302 centered at approximately 700 MHz, a second resonant mode 304 centered at approximately 1 GHz, a third resonant mode 306 centered at approximately 1.7 GHz, and a fourth resonant modes 308 centered at approximately 2.7 GHz. As described herein, other resonant modes may be achieved.

Figure 5:
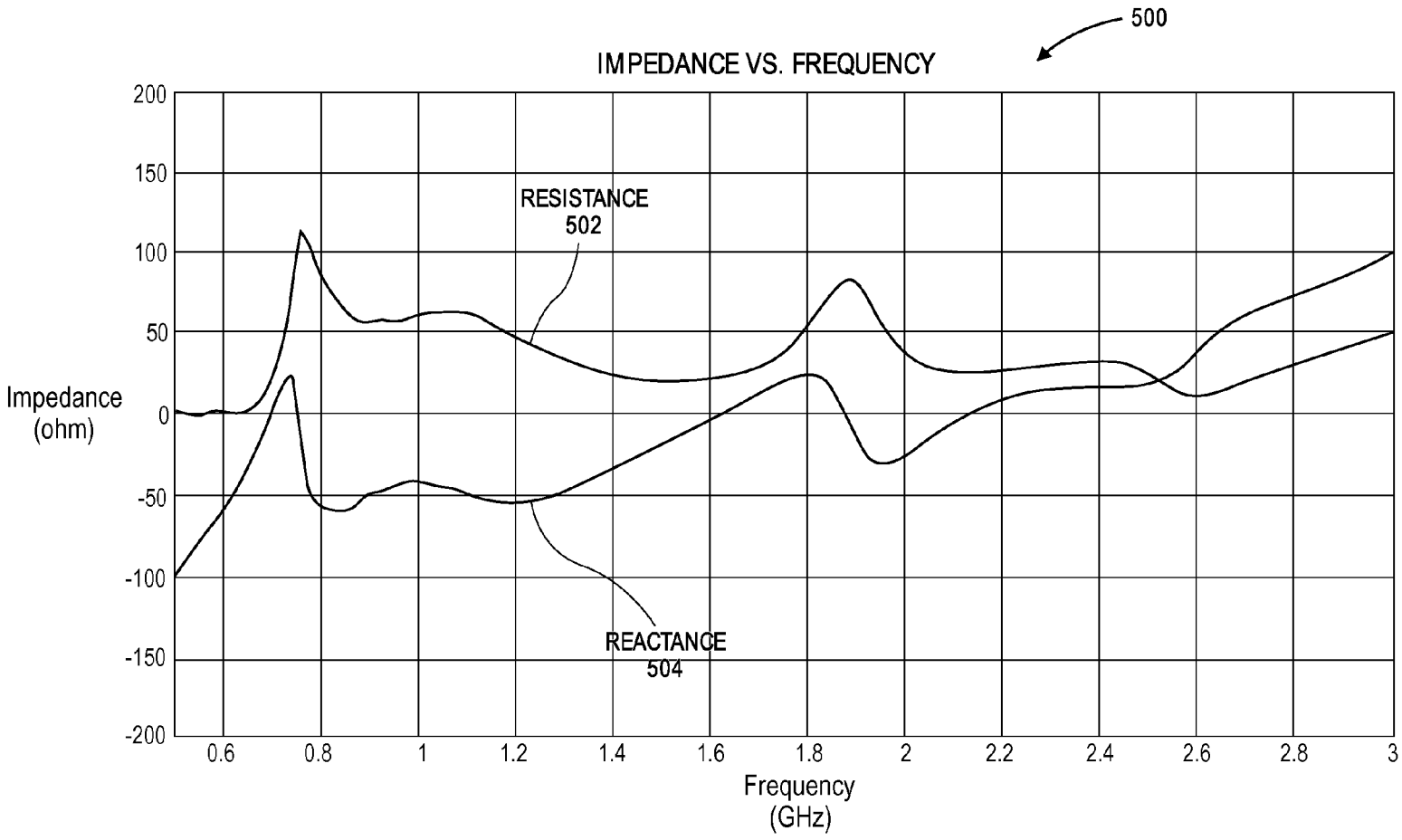
FIG. 5 is a graph of impedance and frequency of the wideband antenna according to one embodiment.

FIG. 5 is a graph 500 of impedance and frequency of the wideband antenna according to one embodiment. The graph 500 illustrates resistance 502 and reactance 504 over a range of frequency of the wideband antenna including a tapered antenna structure and a parasitic ground element, such as those described and illustrated above with respect to wideband antennas 100, 300. The graph 500 illustrates that the wideband antenna with a tapered antenna structure and a parasitic ground element is a viable antenna for the frequency range between 600 MHz and 2.7 GHz.

FIG. 6 illustrates another embodiment of a wideband antenna 600 including a tapered antenna structure 620 and a parasitic ground element 630. The wideband antenna 600 is a 2D structure having an overall first height 631 (H1) and an overall width (W). In one embodiment, the first height 631 (H1) is 20 mm and width (W) is 60 mm. FIG. 7 illustrates another embodiment of a wideband antenna 700 including a tapered antenna structure 720 and a parasitic ground element 730. The wideband antenna 700 is a 2D structure having an overall second height 731 (H2) and an overall width (W). In one embodiment, the second height 731 (H2) is 15 mm and width (W) is 60 mm. FIG. 8 illustrates another embodiment of a wideband antenna 800 including a tapered antenna structure 820 and a parasitic ground element 830. The wideband antenna 800 is a 2D structure having an overall third height 831 (H3) and an overall width (W). In one embodiment, the third height 831 (H3) is 10 mm and width (W) is 60 mm. As shown in FIGS. 6-8, the dimensions of the tapered antenna structures and the parasitic ground elements can be varied to obtain different heights. In other embodiments, other dimensions can be used as would be appreciated by one of ordinary skill in the art having the benefit of this disclosure. Also, in other embodiments, the tapered antenna structures and the parasitic ground elements can be 3D structures. In some embodiments, the tapered antenna structure, the parasitic ground element, or both can be disposed on multiple sides of an antenna carrier. In some embodiments, the overall height of the wideband antenna can be reduced. In one embodiment, the tapered antenna structure and the parasitic ground element are disposed on a front side and a top side of the antenna carrier. This may reduce the overall height of the wideband antenna. It should be noted in the embodiments of 3D structures the wideband antenna has a depth. In one embodiment, the depth is 5 mm. In another embodiment, the depth is 3 mm. As described above, other dimensions are possible for the depth. Also, other configurations are possible as would be appreciated by one of ordinary skill in the art having the benefit of this disclosure.

In the depicted embodiments, the ground plane 140 has the same overall width as the width as the wideband antennas. Alternatively, the ground plane 140 may be less than or greater in width than the wideband antennas.

Figure 9:
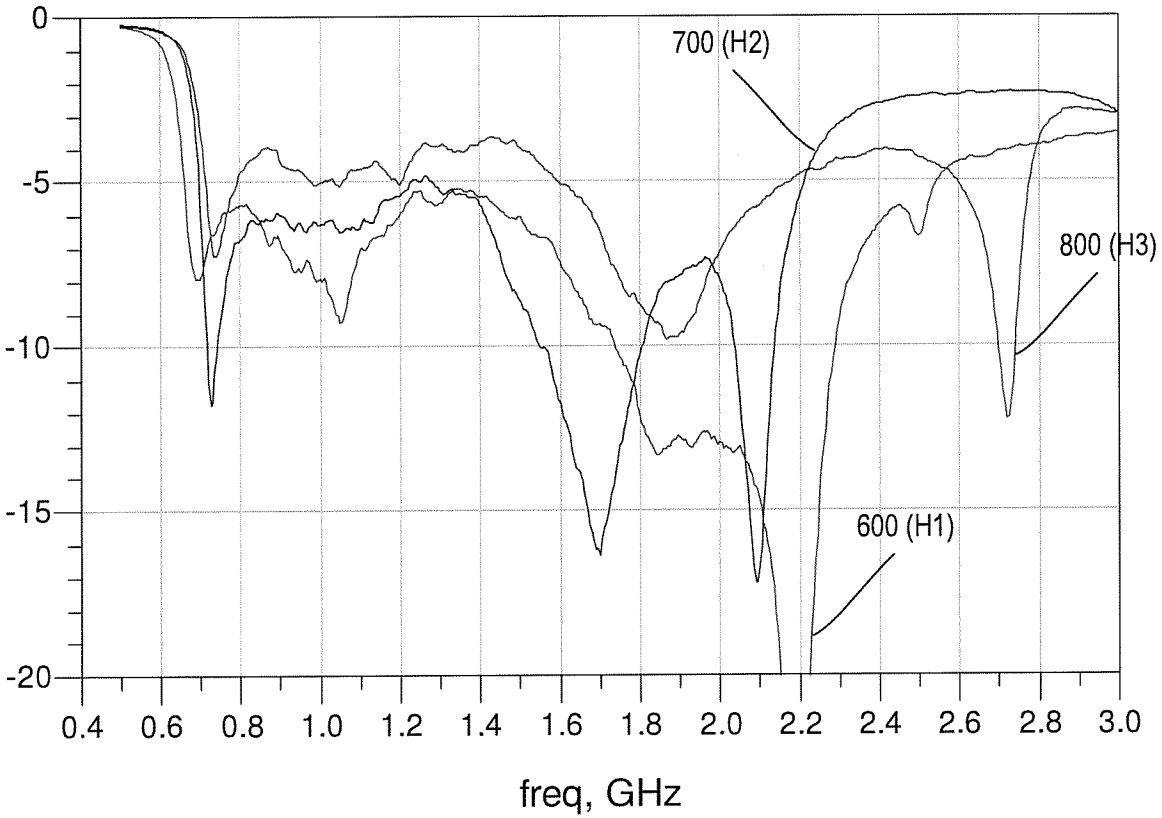
FIG. 9 is a graph of measured return loss of the wideband antennas of FIGS. 6-8 according to one embodiment.

FIG. 9 is a graph 900 of measured return loss of the wideband antennas of FIGS. 6-8 according to one embodiment. The graph 900 shows the measured return loss of each of the wideband antennas 600, 700, and 800. As shown in the graph 900, the different heights of the wideband antenna produce different resonant modes. The measured return loss of each of the wideband antennas 600, 700, and 800 shows that the bandwidth of each of the antennas is between 680 MHz to 2.45 GHz or 2.7 GHz. As described herein, other resonant modes may be achieved.

Strong resonances are not easily achieved within a compact space within user devices, especially with the spaces described above. The structure of the wideband antenna provides multiple strong by controlling the coupling between the parasitic ground element and the tapered antenna structure. Strong resonances, as used herein, refer to a significant return loss at those frequency bands, which is better for impedance matching to 50 ohm systems.

Alternatively, other configurations may be used to add additional resonant modes and to control impedance matching between the wideband antenna and the single RF input as would be appreciated by one of ordinary skill in the art having the benefit of this disclosure. For example, FIG. 8 illustrates an extension area of the parasitic ground element 830. This extension are can be used to change the frequency response in the low band. For example, the extension are may be used to increase the bandwidth in the low band or may be used to create an additional resonant mode. In some embodiment, the wideband antennas described herein include at least three resonant modes. In other embodiments, the wideband antennas include four resonant modes. Alternatively, the wideband antennas may include more than four resonant modes as would be appreciated by one of ordinary skill in the art having the benefit of this disclosure.

It should be noted that the embodiments described herein may be used for a main antenna of the user device, as well as for diversity antennas or Multi-Input and Multi-Output (MIMO) antennas.

Figure 10:
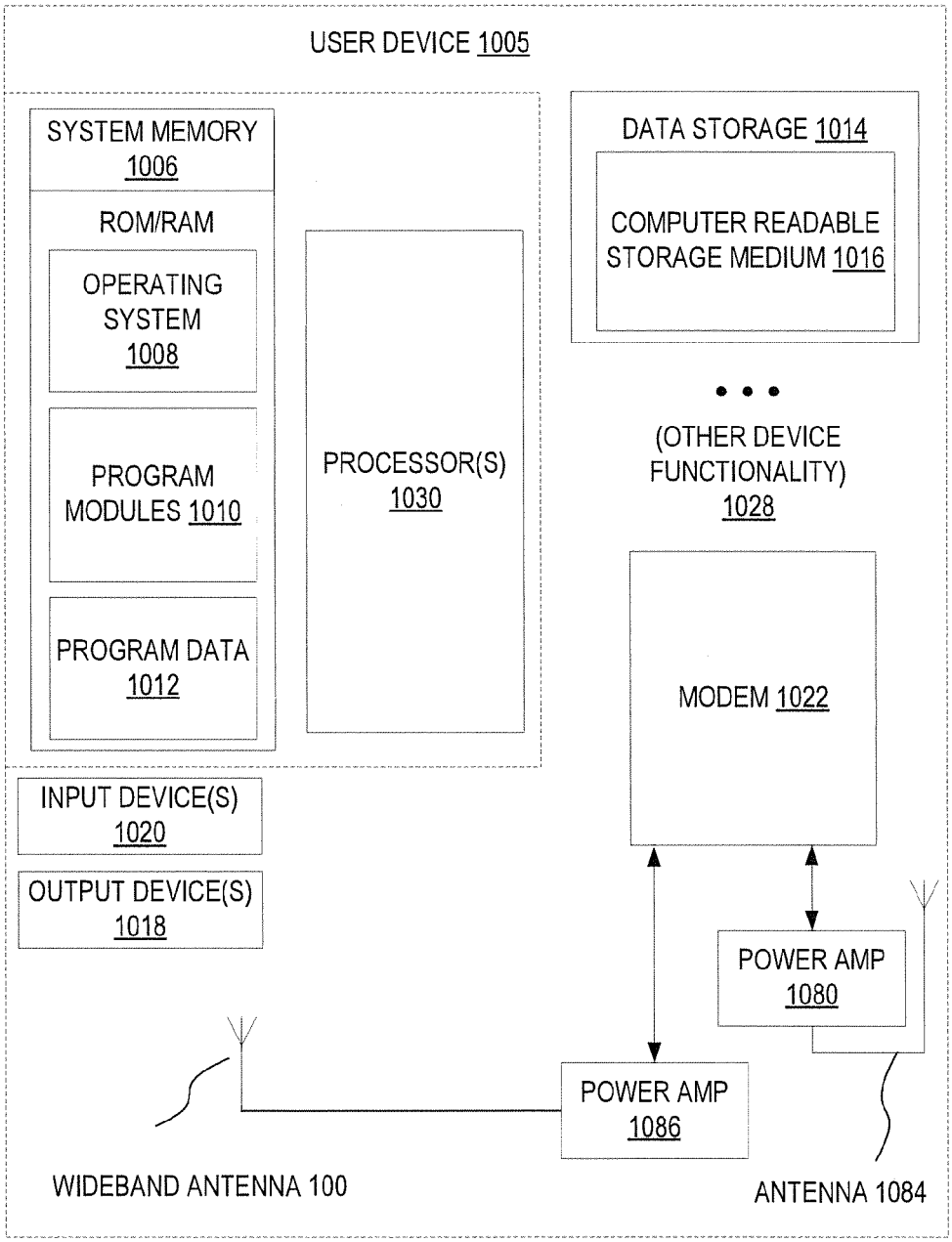
FIG. 10 is a block diagram of a user device having a wideband antenna according to one embodiment.

FIG. 10 is a block diagram of a user device 1005 having the wideband antenna 100 of FIG. 1 according to one embodiment. The user device 1005 includes one or more processors 1030, such as one or more CPUs, microcontrollers, field programmable gate arrays, or other types of processing devices. The user device 1005 also includes system memory 1006, which may correspond to any combination of volatile and/or non-volatile storage mechanisms. The system memory 1006 stores information which provides an operating system component 1008, various program modules 1010, program data 1012, and/or other components. The user device 1005 performs functions by using the processor(s) 1030 to execute instructions provided by the system memory 1006.

The user device 1005 also includes a data storage device 1014 that may be composed of one or more types of removable storage and/or one or more types of non-removable storage. The data storage device 1014 includes a computer-readable storage medium 1016 on which is stored one or more sets of instructions embodying any one or more of the functions of the user device 1005, as described herein. As shown, instructions may reside, completely or at least partially, within the computer readable storage medium 1016, system memory 1006 and/or within the processor(s) 1030 during execution thereof by the user device 1005, the system memory 1006 and the processor(s) 1030 also constituting computer-readable media. The user device 1005 may also include one or more input devices 1020 (keyboard, mouse device, specialized selection keys, etc.) and one or more output devices 1018 (displays, printers, audio output mechanisms, etc.).

The user device 1005 further includes a wireless modem 1022 to allow the user device 1005 to communicate via a wireless network (e.g., such as provided by a wireless communication system) with other computing devices, such as remote computers, an item providing system, and so forth. The wireless modem 1022 allows the user device 1005 to handle both voice and non-voice communications (such as communications for text messages, multimedia messages, media downloads, web browsing, etc.) with a wireless communication system. The wireless modem 1022 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1xRTT), evaluation data optimized (EVDO), high-speed downlink packet access (HSDPA), WiFi, etc. In other embodiments, the wireless modem 1022 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1005 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1005 to communicate with other devices, such as other user devices, server computing systems, telephone devices, or the like. In addition to wirelessly connecting to a wireless communication system, the user device 1005 may also wirelessly connect with other user devices. For example, user device 1005 may form a wireless ad hoc (peer-to-peer) network with another user device.

The wireless modem 1022 may generate signals and send these signals to power amplifier (amp) 1080 or power amp 1086 for amplification, after which they are wirelessly transmitted via the wideband antenna 100 or antenna 1084, respectively. Although FIG. 10 illustrates power amps 1080 and 1086, in other embodiments, a transceiver may be used to all the antennas 110 and 1084 to transmit and receive. The antenna 1084, which is an optional antenna that is separate from the wideband antenna 100, may be any directional, omnidirectional, or non-directional antenna in a different frequency band than the frequency bands of the wideband antenna 100. The antenna 1084 may also transmit information using different wireless communication protocols than the wideband antenna 100. In addition to sending data, the wideband antenna 100 and the antenna 1084 also receive data, which is sent to wireless modem 1022 and transferred to processor(s) 1030. It should be noted that, in other embodiments, the user device 1005 may include more or less components as illustrated in the block diagram of FIG. 10.

In one embodiment, the user device 1005 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the wideband antenna 100 that operates at a first frequency band and the second wireless connection is associated with a second resonant mode of the wideband antenna 100 that operates at a second frequency band. In another embodiment, the first wireless connection is associated with the wideband antenna 100 and the second wireless connection is associated with the antenna 1084. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1022 is shown to control transmission to both antennas 110 and 1084, the user device 1005 may alternatively include multiple wireless modems, each of which is configured to transmit/receive data via a different antenna and/or wireless transmission protocol. In addition, the user device 1005, while illustrated with two antennas 110 and 1084, may include more or fewer antennas in various embodiments.

The user device 1005 delivers and/or receives items, upgrades, and/or other information via the network. For example, the user device 1005 may download or receive items from an item providing system. The item providing system receives various requests, instructions, and other data from the user device 1005 via the network. The item providing system may include one or more machines (e.g., one or more server computer systems, routers, gateways, etc.) that have processing and storage capabilities to provide the above functionality. Communication between the item providing system and the user device 1005 may be enabled via any communication infrastructure. One example of such an infrastructure includes a combination of a wide area network (WAN) and wireless infrastructure, which allows a user to use the user device 1005 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 1005.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1005 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1005 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 11:
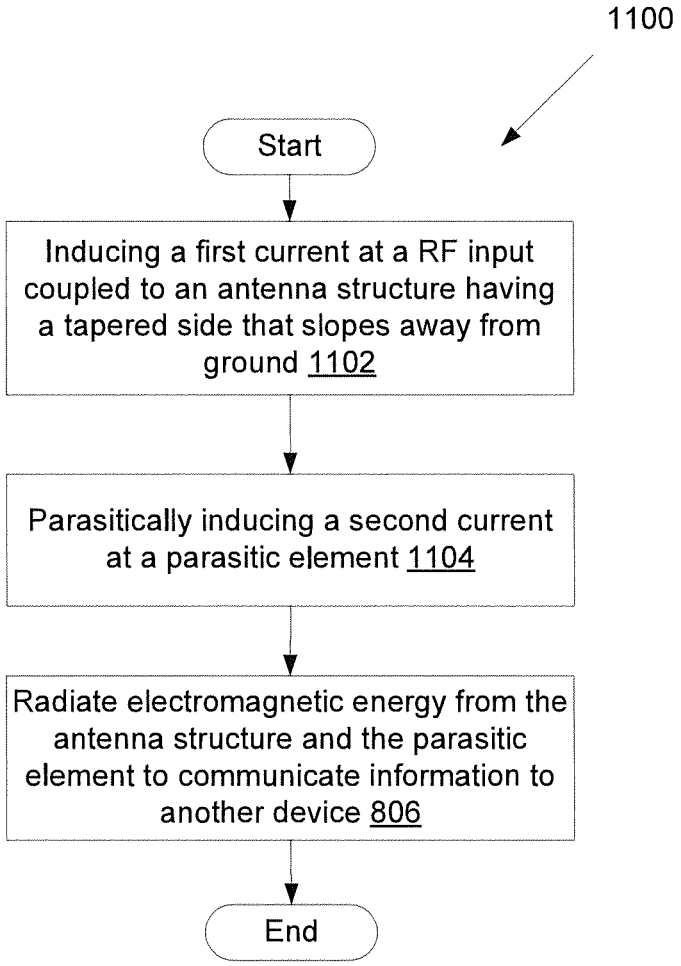
FIG. 11 is a flow diagram of an embodiment of a method of operating a user device having a wideband antenna according to one embodiment.

FIG. 11 is a flow diagram of an embodiment of a method 1100 of operating a user device having a wideband antenna according to one embodiment. In method 1100, a first current is induced at a single radio frequency (RF) input coupled to an antenna structure (e.g., tapered antenna structure 120) (block 1102). In response, the antenna structure parasitically induces a second current at a parasitic element, the parasitic element not being conductively connected to the antenna structure (block 1104). In response to the induced currents, electromagnetic energy is radiated from the antenna structure and the parasitic element to communicate information to another device (block 1106). The electromagnetic energy forms a radiation pattern. The radiation pattern may be various shapes as would be appreciated by one of ordinary skill in the art having the benefit of this disclosure.

In one embodiment, a current is induced at the RF input, which induces a surface current flow of the wideband antenna. The wideband antenna parasitically induces a current flow of the second antenna. By inducing current flow at the second antenna, the second antenna increases the bandwidth of the wideband antenna, providing additional two or more resonant modes to the resonant mode of the wideband antenna. As described herein, the second antenna is physically separated from the wideband antenna by a gap.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. An apparatus comprising:

a single radio frequency (RF) input;

a tapered antenna structure coupled to the single RF input, wherein the tapered antenna structure is configured to provide a plurality of resonant modes of a wideband antenna; and a parasitic ground element coupled to a ground plane, the parasitic ground element is configured to provide another resonant mode of the wideband antenna and is configured to provide impedance matching to the tapered antenna structure, wherein the tapered antenna structure comprises:

a first side that extends away from a first point where the tapered structure is coupled to the single RF input along a first axis that is perpendicular to the ground plane to a third point at a distal end of the first side, the distal end being farthest from the single RF input;

a tapered side that tapers away from the first point towards a second point at an angle relative to the first axis;

a third side that extends away from the third point along a second axis that is parallel to the ground plane to a fourth point;

an arm portion that extends away from the third point along the second axis in an opposite direction than the third side relative to the first axis, wherein the arm portion does not physically connect to the ground plane, wherein a rectangular element of the parasitic ground element is disposed along a third axis parallel to the second axis to form a first gap between the arm portion and the rectangular element and a second gap between the third side and the rectangular element; and an extension portion that extends from the fourth point on the third side away from the ground plane and up to or beyond the third axis of the rectangular element, the extension portion forming a third gap between the extension portion and the rectangular element.

2. The apparatus of claim 1, wherein the tapered antenna structure and the parasitic ground element are configured to extend a bandwidth of the wideband antenna.

3. The apparatus of claim 2, wherein the bandwidth of the wideband antenna is between 700 MHz and 2.7 GHz.

4. The apparatus of claim 2, wherein the bandwidth of the wideband antenna is between 700 MHz and 6 GHz.

5. The apparatus of claim 1, wherein the tapered antenna structure is configured to provide three resonant modes for the plurality of resonant modes.

6. The apparatus of claim 1, wherein the parasitic ground element is configured to provide a first resonant mode, centered at 700 MHz as the other resonant mode, and wherein the plurality of resonate modes comprises a second resonant mode centered at 1 GHz, a third resonant mode centered at 1.7 GHz, and a fourth resonant mode centered at 2.4 GHz.

7. The apparatus of claim 6, wherein a bandwidth of the wideband antenna is between 700 MHz and 2.7 GHz.

8. The apparatus of claim 1, wherein the tapered antenna structure comprises:

a triangular portion comprising the first side, the third side and the tapered side;

the arm portion extending out from the first side of the triangular portion; and the extension portion extending out from the third side of the triangular portion.

9. The apparatus of claim 8, wherein the triangular portion is configured to provide a second resonant mode of the plurality of resonant modes in a high band and to provide a bandwidth of the wideband antenna, wherein the arm portion is configured to provide a third resonant mode of the plurality of resonant modes in the high band and is configured to increase the bandwidth of the wideband antenna in the high band, and wherein the extension portion is configured to provide a fourth resonant mode of the plurality of resonant modes in the high band and is configured to increase the bandwidth of the wideband antenna in the high band.

10. The apparatus of claim 9, wherein the parasitic ground element is configured to provide a first resonant mode in a low band and is configured to increase the bandwidth of the wideband antenna in the low band.

11. The apparatus of claim 10, further comprising a ground line configured to couple the parasitic ground element to the ground plane, wherein the ground line is configured to extend the bandwidth in the first and fourth resonant modes.

12. The apparatus of claim 10, further comprising a ground line configured to couple the parasitic ground element to the ground plane, wherein the ground line is configured to extend the bandwidth in the first, third, and fourth resonant modes.

13. The apparatus of claim 8, wherein the arm portion and the extension portion are configured to increase coupling between the tapered antenna structure and the parasitic ground element.

14. The apparatus of claim 1, wherein the second gap is greater than the first gap.

15. The apparatus of claim 1, wherein the tapered side that tapers at the angle relative to the first axis is configured to extend a bandwidth of frequency coverage of the wideband antenna.

16. The apparatus of claim 1, further comprising a ground line configured to couple the parasitic ground element to the ground plane.

17. An apparatus comprising:

a radio frequency (RF) input;

a parasitic element coupled to a ground plane; and an antenna structure coupled to the RF input at a first point, wherein the antenna structure comprises a first side that extends away from the first point along a first axis perpendicular to the ground plane to a third point, a tapered side that tapers away from the first point at a specified angle relative to the first axis to create an increasingly larger gap between the antenna structure and the ground plane and a third side that extends from the third point along a second axis to a fourth point, wherein the antenna structure further comprises an arm portion that extends away from the third point in an opposite direction than the third side, wherein the antenna structure is configured to operate as a feeding structure to the parasitic element, wherein the parasitic element is not conductively connected to the antenna structure, wherein the parasitic element is disposed along a third axis parallel to the second axis to form a gap between the arm portion and a portion of the parasitic element, wherein the antenna structure further comprises an extension portion that extends from the fourth point on the third side away from the ground plane and up to or beyond the third axis of the parasitic element.

18. The apparatus of claim 17, wherein the antenna structure and the parasitic element are configured to provide a bandwidth between 700 MHz and 2.7 GHz.

19. The apparatus of claim 17, wherein the antenna structure and the parasitic element are configured to provide a bandwidth between 700 MHz and 6 GHz.

20. The apparatus of claim 17, wherein the antenna structure comprises:

a triangular portion comprising the first side, third side, and the tapered side;

the arm portion extending out from the first side of the triangular portion; and the extension portion extending out from the third side of the triangular portion.

21. The apparatus of claim 20, wherein the parasitic element is configured to provide a first resonant mode in a low band and is configured to increase a bandwidth of the antenna structure in the low band, wherein the triangular portion is configured to provide a second resonant mode in a high band, wherein the arm portion is configured to provide a third resonant mode in the high band and is configured to increase the bandwidth of the antenna structure in the high band, and wherein the extension portion is configured to provide a fourth resonant mode in the high band and is configured to increase the bandwidth of the antenna structure in the high band.

22. A user device comprising:

a wireless modem; and a wideband antenna configured to radiate electromagnetic energy to communicate data to and from the wireless modem via a radio frequency (RF) input coupled to the wireless modem, wherein the wideband antenna comprises:

a parasitic element coupled to a ground plane; and an antenna structure coupled to the RF input at a first point, wherein the antenna structure comprises a first side that extends away from the first point along a first axis perpendicular to the ground plane to a third point, a tapered side that tapers away from the first point to create an increasingly larger gap between the antenna structure and the ground plane on the first side along the first axis, and a third side that extends from the third point along a second axis to a fourth point, wherein the antenna structure further comprises an arm portion that extends away from third point in an opposite direction than the third side, wherein the antenna structure is configured to operate as a feeding structure to the parasitic element, wherein the parasitic element is not conductively connected to the antenna structure, wherein the parasitic element is disposed along a third axis parallel to the second axis to form a gap between the arm portion and a portion of the parasitic element, wherein the antenna structure further comprises an extension portion that extends from the fourth point on the third side away from the ground plane and up to or beyond the third axis of the parasitic element.

23. The user device of claim 22, further comprising a transceiver coupled to the wireless modem and the RF input.

24. The user device of claim 22, wherein a bandwidth of the wideband antenna is between 700 MHz and 2.7 GHz.

25. The user device of claim 22, wherein a bandwidth of the wideband antenna is between 700 MHz and 6 GHz.

26. The user device of claim 22, wherein the wideband antenna is disposed on an antenna carrier disposed at least partially above the ground plane.

27. A method of operating a user device, the method comprising:

inducing a first current at a radio frequency (RF) input coupled to an antenna structure of a wideband antenna, wherein the antenna structure comprises:

a first side that extends away from a first point along a first axis perpendicular to a ground plane to a third point, a tapered side that tapers away from the first point to create an increasingly larger gap between the antenna structure and the ground plane, a third side that extends from the third point along a second axis to a fourth point, an arm portion that extends away from the third point along the second axis in an opposite direction than the third side, the arm portion not physically connecting to the ground plane, and an extension portion that extends from the fourth point on the third side away from the ground plane and up to or beyond a third axis;

in response, parasitically inducing a second current at a parasitic element of the wideband antenna, wherein the parasitic element is not conductively connected to the antenna structure, wherein a rectangular element of the parasitic element is disposed along the third axis parallel to the second axis to form a first gap between the arm portion and the rectangular element, a second gap between the third side and the rectangular element, and a third gap between the extension portion and the rectangular element; and radiating electromagnetic energy from the antenna structure and the parasitic element to communicate information to another device in response to the first and second currents.

28. The method of claim 27, wherein said inducing the first current provides a plurality of resonant modes in a high band, and wherein said inducing the second current provides a resonant mode in a low band.

29. The method of claim 28, wherein the resonant mode in the low band is centered at 700 MHz, and wherein the plurality of resonant modes comprises a second resonant mode centered at 1 GHz, a third resonant mode centered at 1.7 GHz, and a fourth resonant mode centered at 2.4 GHz.

* * * * *